US005806788A

United States Patent [19]

Witwer et al.

[11] Patent Number: 5,806,788

[45] Date of Patent: Sep. 15, 1998

[54] KNOCKDOWN REEL ASSEMBLY

[75] Inventors: Richard P. Witwer, Lancaster; Kenneth E. Campbell, York, both of Pa.

[73] Assignee: Direct Wire and Cable, Inc., Denver, Pa.

[21] Appl. No.: 884,412

[22] Filed: Jun. 27, 1997

[51] Int. Cl.[6] ..... B65H 75/22

[52] U.S. Cl. ..... 242/608.6; 242/609.1; 242/118.6

[58] Field of Search ..... 242/608, 608.6, 242/609, 609.1, 613, 614, 614.1, 118.6, 118.61

[56] References Cited

U.S. PATENT DOCUMENTS

| | | | |
|---|---|---|---|
| 2,156,363 | 5/1939 | Tucker, Jr. | 242/608.7 |
| 2,874,919 | 2/1959 | De Long . | |
| 2,902,235 | 9/1959 | Morin . | |
| 2,992,789 | 7/1961 | Sardeson | 242/118.61 |
| 3,552,677 | 1/1971 | Hacker . | |
| 3,635,421 | 1/1972 | Boland et al. . | |
| 3,785,584 | 1/1974 | Crellin, Jr. . | |
| 3,822,841 | 7/1974 | Campbell . | |
| 3,940,085 | 2/1976 | Campbell . | |
| 4,002,309 | 1/1977 | Ruiz-Barbotteau | 242/609.1 |
| 4,471,919 | 9/1984 | Leunig . | |
| 4,903,913 | 2/1990 | McCaffrey . | |
| 4,976,475 | 12/1990 | Bjorkqvist . | |
| 5,114,089 | 5/1992 | Posso . | |
| 5,575,437 | 11/1996 | Campbell . | |

*Primary Examiner*—John P. Darling
*Attorney, Agent, or Firm*—Howson and Howson

[57] ABSTRACT

A reel assembly for large packages of cable and wire. The reel assembly includes a pair of separate drum segments which, when assembled, form a hollow cylindrical drum for winding wire or cable therearound. The drum segments have inwardly extending beads which lock separate end flanges on opposite sides of the drum. The end flanges are of two piece construction including a hub secured to a skirt The hub has a lip for engaging the beads of the drum segments when the reel is assembled. The reel assembly has means for automatically releasably locking the drum segments to the hub lip when the drum segments side edges are urged into engagement with one another.

19 Claims, 5 Drawing Sheets

KNOCKDOWN REEL ASSEMBLY

FIELD OF THE INVENTION

The present invention relates to reel assemblies for shipping wire, cables and the like, and more particularly, the present invention relates to a returnable and re-useable knockdown reel assembly which is inexpensive to manufacture, which is readily assembled and disassembled, and which is lightweight to minimize shipping costs.

BACKGROUND OF THE INVENTION

It is conventional practice within the wire and cable manufacturing industry to ship wire or cable wound on reels to the purchaser who, after unwinding the wire or cable from the reels, then disposes of the reels or returns the reels assembled for re-use. The basic structure of the assembled reel includes a cylindrical drum about which the wire or cable is wound and a pair of end flanges extending transversely from the ends of the drum to retain the wound wire or cable on the drum. In use, the assembled reels are mounted for rotation about an axis extending through the cylindrical drum and end flanges so that the wire or cable unwinds from the reel assembly as the reel is rotated.

One example of a knockdown, or collapsible, reel is disclosed in U.S. Pat. No. 3,940,085 issued to Kenneth E. Campbell who is one of the named inventors of the present application. The reel assembly has a pair of separate drum segments and a pair of separate end flanges with upstanding hubs having grooves formed therein. The drum segments capture the end flanges with inwardly extending beads mating with the grooves of the hubs. For alignment purposes, the elongate side edges of the drum segments have lugs and recesses which cooperate with lugs and recesses of the elongate side edges of the mating drum segment. The entire assembly is maintained in an assembled state by the use of bolts which lock the two drum segments together.

U.S. Pat. No. 5,575,437, also issued to Kenneth E. Campbell, discloses a knockdown reel assembly which also utilizes a pair of drum segments and a pair of end flanges. The end flanges have recessed sockets which independently receive each drum segment and lock them in place with a latching mechanism.

U.S. Pat. No. 4,471,919 issued to Leunig discloses a knockdown reel assembly which utilizes drum segments with locking beads, or rings, to capture the upstanding hubs of the end flanges. The drum segments are integrally connected along one mating pair of elongate side edges by a hinge and are releasably connected along the other mating pair of elongate side edges by an elongate snap-fitting tongue and groove interlock.

U.S. Pat. Nos. 3,822,841 issued to Kenneth E. Campbell, 3,785,584 issued to Crellin, Jr., 3,552,677 issued to Hacker, and 4,903,913 issued to McCaffrey disclose other knockdown reel assemblies known in the art.

While many of the known knockdown reel assemblies are suited for use with smaller packages of wire or cable, they may not be useful with heavy duty gauge wire and cable or larger packages of wire or cable. For purposes of this application, large packages includes large quantities of smaller gauge wire or quantities of large gauge wire that cannot be efficiently packaged on known knock-down reel assemblies. Reel constructions which are merely sized-up to provide larger packages may not be structurally sound and may be expensive to manufacture. For instance, an injection molded component having dimensions greater than about 24 inches by about one inch increases molding expenses by a factor of 10 due to the expense of the mold.

Although various ones of the aforementioned knockdown reel assemblies may be satisfactory for their intended purposes, there is a need for an improved knockdown reel assembly which is structurally sound, inexpensive to manufacture and ship, and which can be readily disassembled and returned to the wire or cable manufacturer.

OBJECTS OF THE INVENTION

With the foregoing in mind, a primary object of the present invention is to provide a knockdown reel assembly used to ship flaccid material which can be readily assembled and disassembled without the use of special tools.

Another object of the present invention is to provide a knockdown reel assembly which is inexpensive to manufacture and which is lightweight to reduce shipping expenses.

A further object of the present invention is to provide a knockdown reel assembly which is made from a number of mix and match components which can each be readily replaced should a part become damaged and which can each be mated with other components within a range of sizes to customize the dimensions of an assembled reel.

A still further object of the present invention is to provide a knockdown reel assembly which provides for a reduction of floor space required for reel component inventories since various sized components can be mixed and matched to provide reel assemblies having a wide range of dimensions.

SUMMARY OF THE INVENTION

More specifically, the present invention provides a knockdown returnable reel assembly for shipping flaccid material. The reel assembly has a substantially cylindrical drum for winding the wire-like material therearound and a pair of end flanges located at opposite ends of the drum to retain the wire-like material on the drum between the end flanges.

A pair of separate, identical, arcuate drum segments mate to form the cylindrical drum. Each drum segment has arcuate-shaped opposite ends with inwardly extending beads which each mate with one of the end flanges and a pair of elongate side edges which each mate with one of the elongate side edges of the other drum segment. Each end flange has a hub with a centered aperture extending axially therethrough and a radially extending lip which is lockingly engaged, or captured, by the beads of the drum segments.

One of the improvements is in the use of at least one locking finger extending peripherally from at least one of the elongate side edges of the drum segments for maintaining the reel assembly in a releasable locking engagement. The locking finger has a radially inwardly extending locking abutment for forming the engagement with either a notch in the hub of the end flange or the mating drum element.

Another improvement involves notches formed in the hubs of the end flanges which mate with the locking fingers to form the releasable locking engagement between each drum segment and each hub.

A further improvement involves the use of a two piece end flange assembly constructed in a manner to reduce wear and to reduce manufacturing costs.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENTS

Figure 1:
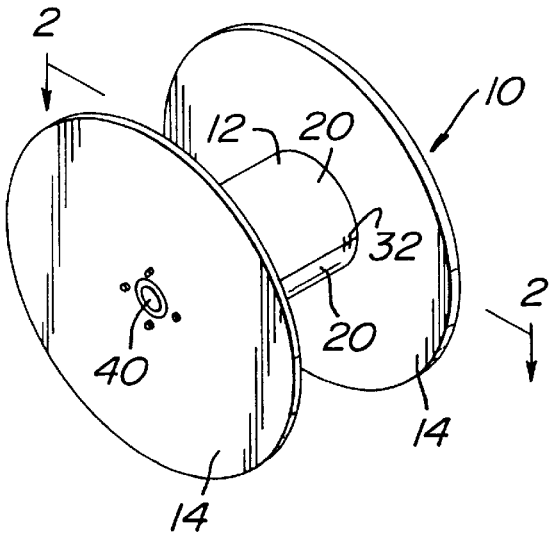
FIG. 1 is a perspective view of an assembled reel embodying the present invention.

As illustrated in FIG. 1, the reel assembly 10 of the present invention, when assembled, provides a means for storing and shipping flaccid material of various sizes from a manufacturer to an end user. For purposes of this application, flaccid material can include, but is not limited to: wire, cable, conduit, hose, terminal strips, paper, filler, fiber-optics, chain, rope, yarn and metal strips.

Figure 2:
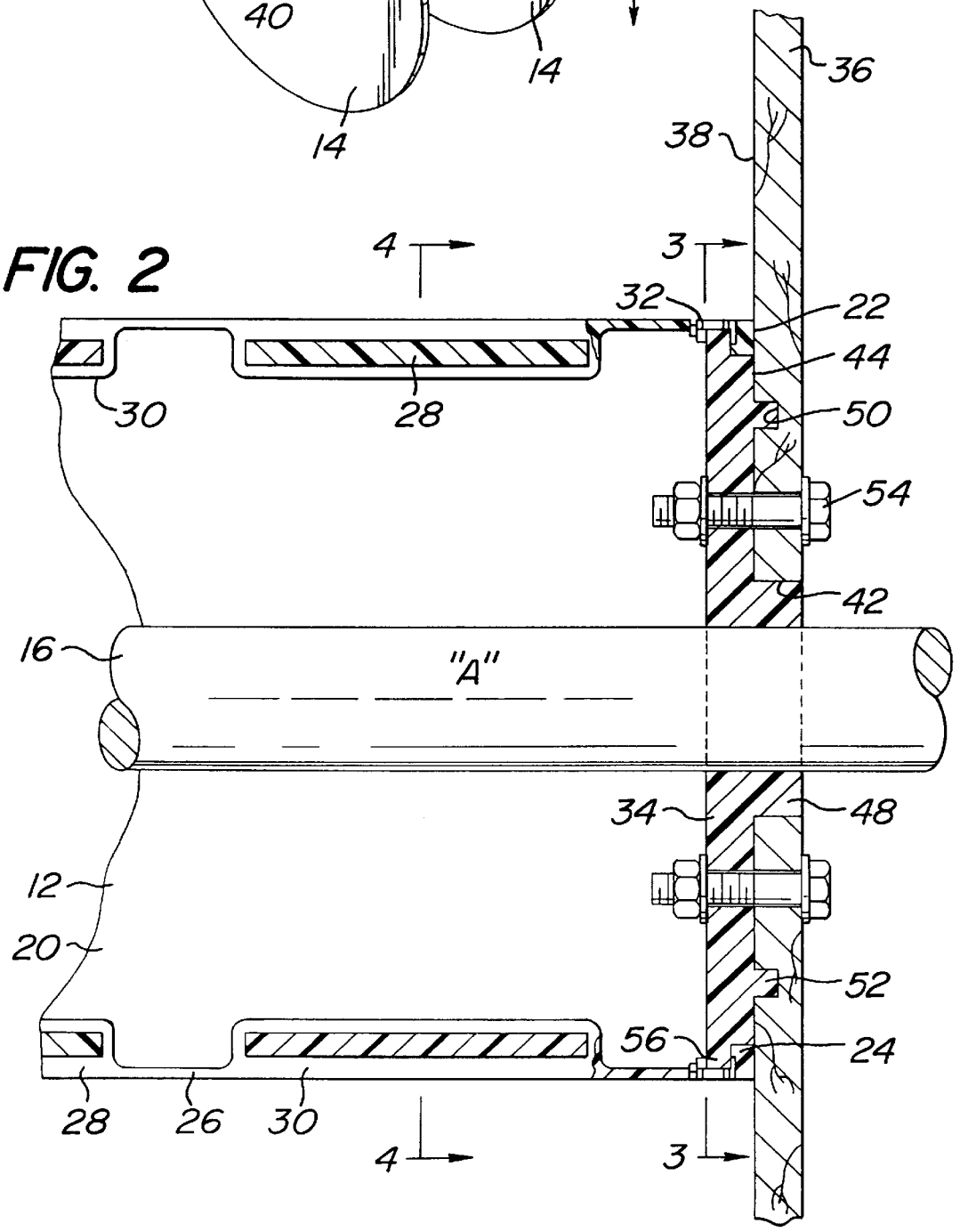
FIG. 2 is a cross-sectional view of the assembled reel illustrated in FIG. 1, the view taken along the line 2—2.

The reel assembly 10 has a substantially cylindrical drum 12 sandwiched between a pair of end flanges 14. To facilitate winding and unwinding of flaccid material (not shown) on and off the drum 12, the reel assembly 10 has a central passageway extending along an axis "A" through the drum 12 and both end flanges 14. As best illustrated in FIG. 2, the reel assembly 10 can be supported on, and rotated about, a rod 16 extending through the central passageway along the axis "A".

For environmental and cost saving purposes, the end user can ship an empty reel back to the manufacturer for re-use. The reel assembly 10 is designed for ready disassembly so that further savings can be achieved by minimizing the shipping and storage space required. To this end, the cylindrical drum 12 can be disassembled into a pair of separate drum segments 20 and a pair of separate end flanges 14.

As illustrated, each drum segment 20 is identical to its mating drum segment and is arcuate in cross-section between its arcuate-shaped opposite ends 22. A bead 24 extends inwardly from each end 22 for capturing the end flanges 14, as will be discussed. Each drum segment 20 also has a pair of elongate side edges 26 which mate with the elongate side edges of a mating drum segment. To this end, each drum segment 20 has a tongue tab 28 and/or a groove tab 30 which engage the tongue and/or groove tabs of a mating drum segment to prevent longitudinal and transverse movement therebetween. Preferably, the drum segments 20 are made of plastic so that they are lightweight to minimize shipping costs and, by being identical, the drum segments can be molded by a single injection mold thereby providing manufacturing cost savings.

The drum segments 20 of the present invention have a unique configuration of integrally formed locking fingers 32 which provide a means for releasably locking the entire reel assembly in an assembled state when the drum segments are urged together during assembly. Preferably, as illustrated, a pair of locking fingers 32 extend peripherally on each elongate side edge 26, one adjacent each bead 24. The locking fingers 32 function as leaf springs since they can be urged outwardly during assembly, or disassembly, but snap back inwardly when mounted on the end flanges 14 to lock the reel in an assembled state. Preferably, the locking fingers 32 effect the locking engagement with the end flanges 14 as illustrated and as will be discussed.

Another aspect of the present invention involves the unique two piece construction of each end flange 14. Each end flange 14 has a hub 34 secured to a separate flange portion, or skirt, 36. Preferably, to minimize manufacturing costs, the skirt 36 is made of plywood and the hub 34 is of injection molded plastic. For shipping heavy flaccid material, the skirt 36 may be required to have a diameter as large as about 48 inches. A skirt 36 of this size made of plywood provides a significant cost savings over a skirt of an identical size made of plastic, since the cost to manufacture a mold of that size is significant, not to mention the higher cost of engineering-grade plastic relative to plywood. However, if higher costs are acceptable, the skirt 36 can be made of engineering-grade plastic, wood, metal or composite materials.

The plastic hub 34 of the present invention is particularly configured to provide the bearing surface between the rod 16 and the reel assembly 10 to prevent wear of the skirt 36. To this end, the skirt 36 has a sidewall 38 which confronts the drum segments 20 and a central aperture 40 defined by an inner annular surface 42 extending transversely from the sidewall 38. The hub 34 has a side 44 which confronts the sidewall 38 of the skirt 36 and has a central aperture 46 which is aligned with the aperture 40 of the skirt 36 when assembled. The hub 34 has a first annular projection 48 extending from the side 44 which is received within the skirt central aperture 40 to receive the inner annular surface 42 of the skirt 36. Thus, as illustrated in FIG. 2, the rod 16 does not contact and wear-down the skirt 36.

Figure 6:
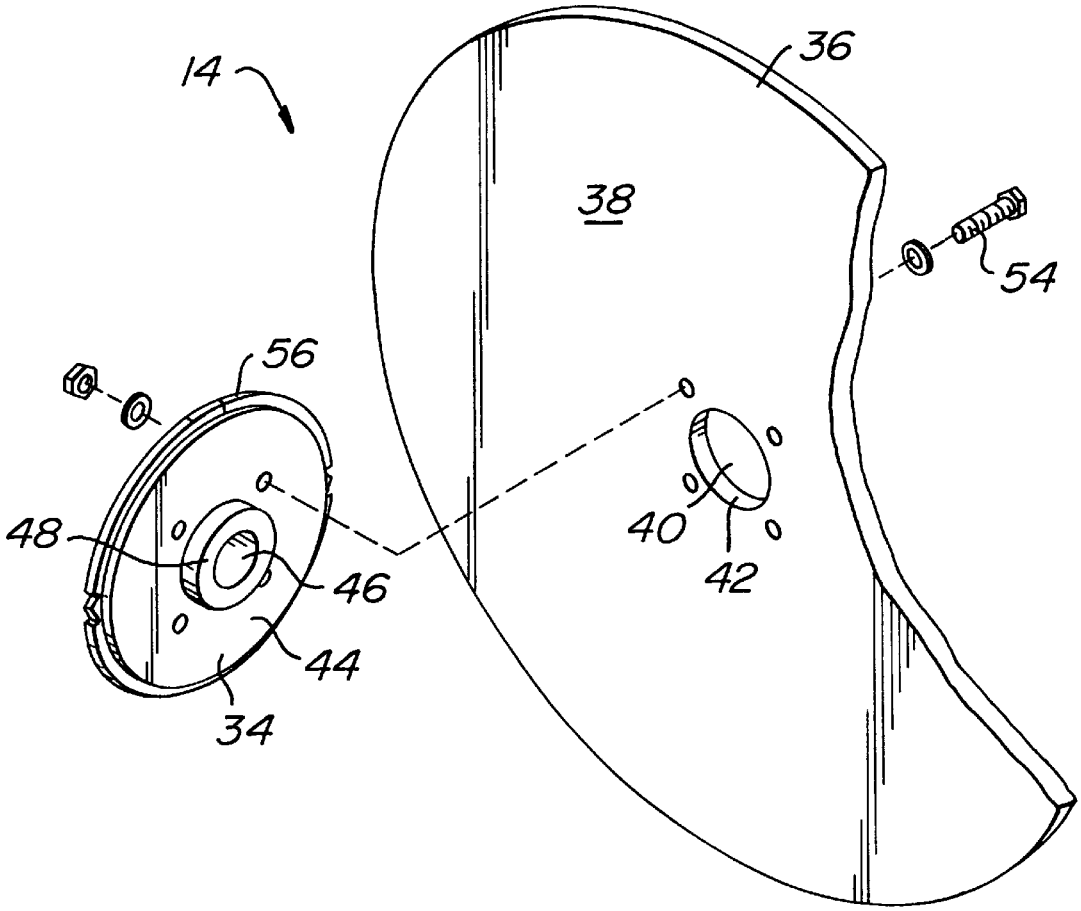
FIG. 6 is a partial exploded perspective view of an alternate embodiment of an end flange.

The hub 34 is secured to the skirt 36 in a manner to provide an end flange 14 which is structurally sound and which can withstand the forces associated with winding, shipping, and unwinding of flaccid material. To this end, the sidewall 38 of the skirt 36 has an annular groove 50 formed concentric with its aperture 40, and the hub 34 has a second annular projection 52 extending from its side 44 and received within the groove 50. See FIG. 2. A plurality of threaded fasteners, such as the nut and bolt combinations 54, are used to secure the mating hub 34 and skirt 36 together to produce the end flange 14. In an alternate embodiment illustrated in FIG. 6, the sidewall 38 does not include an annular groove and the hub does not have a second annular projection. In such an embodiment, the locations of the nuts and bolts 54 are moved outwardly closer to the outer edge of the hub 34.

The hub 34 cooperates with the beads 24 on the drum segments 20 to provide a releasable connection between the drum segments 20 and the end flanges 14. To this end, the hub 34 has a lip 56 which extends radially outward from the hub 34 a spaced distance from the sidewall 38 of the skirt 36. Thus, when the reel is assembled, the hubs 34 receive and capture the beads 24 of the drum segments between the lip 56 of the hub 34 and the sidewall 38 of the skirt 36.

Figure 3:
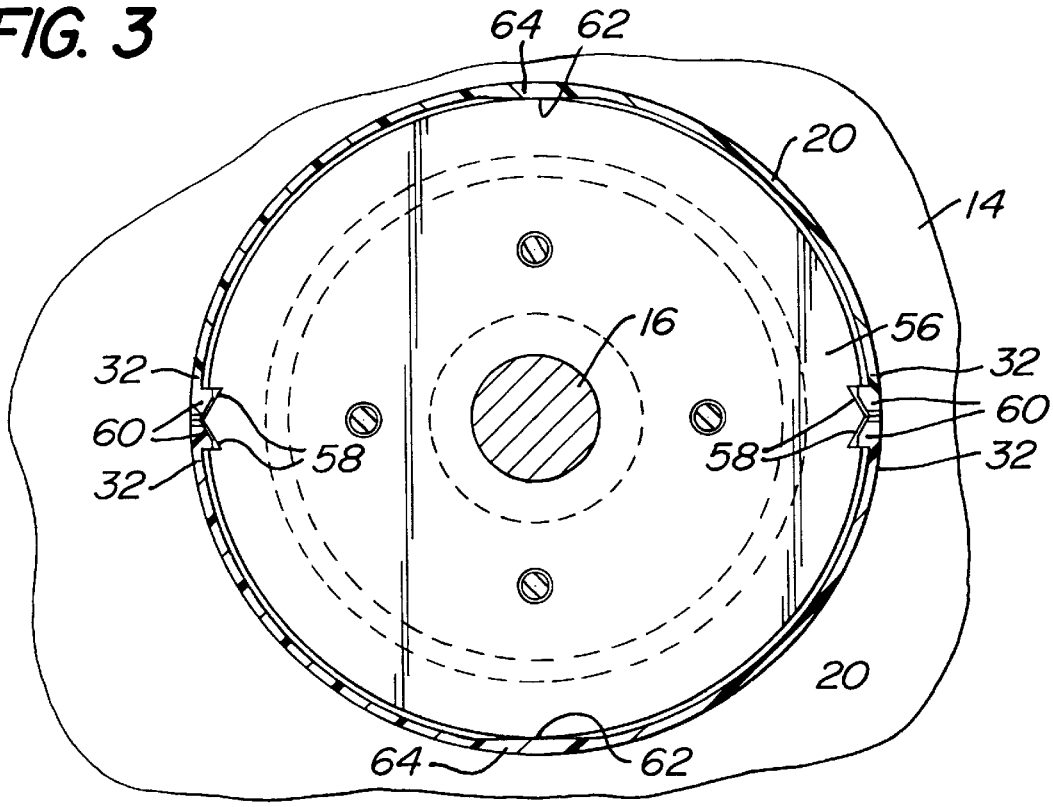
FIG. 3 is a cross-sectional view of the assembled reel illustrated in FIG. 2, the view taken along the line 3—3.
Figure 4:
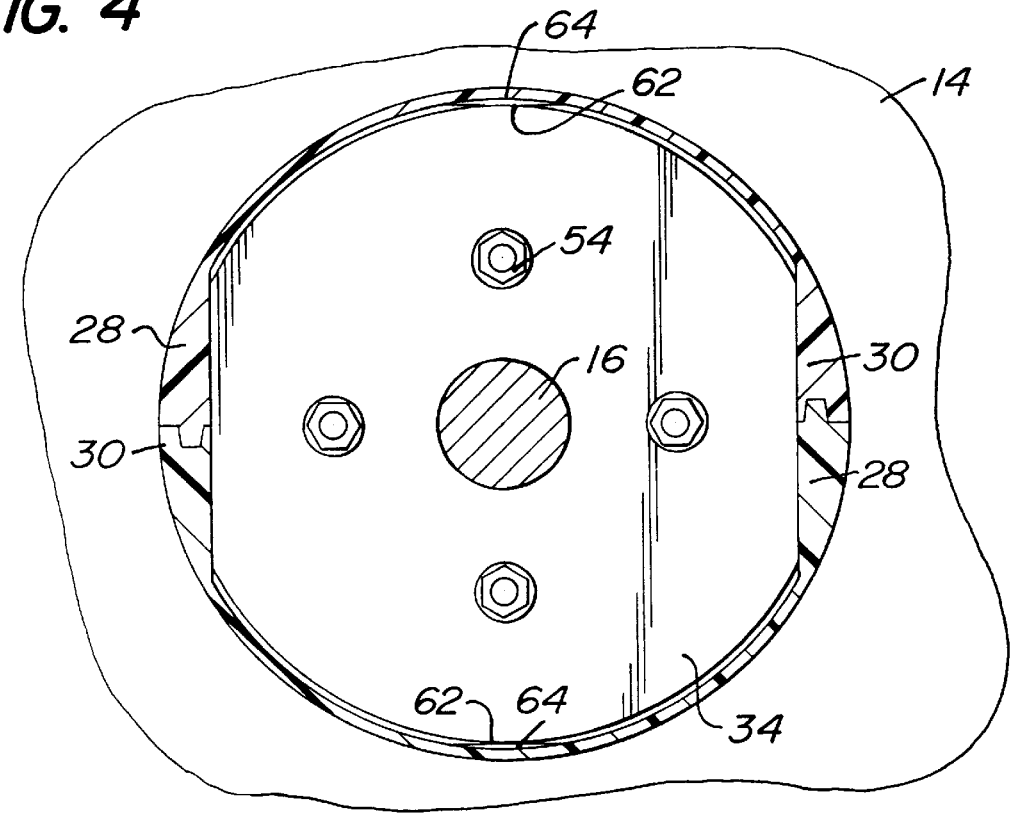
FIG. 4 is a cross-sectional view of the assembled reel illustrated in FIG. 3, the view taken along the line 4—4.
Figure 5:
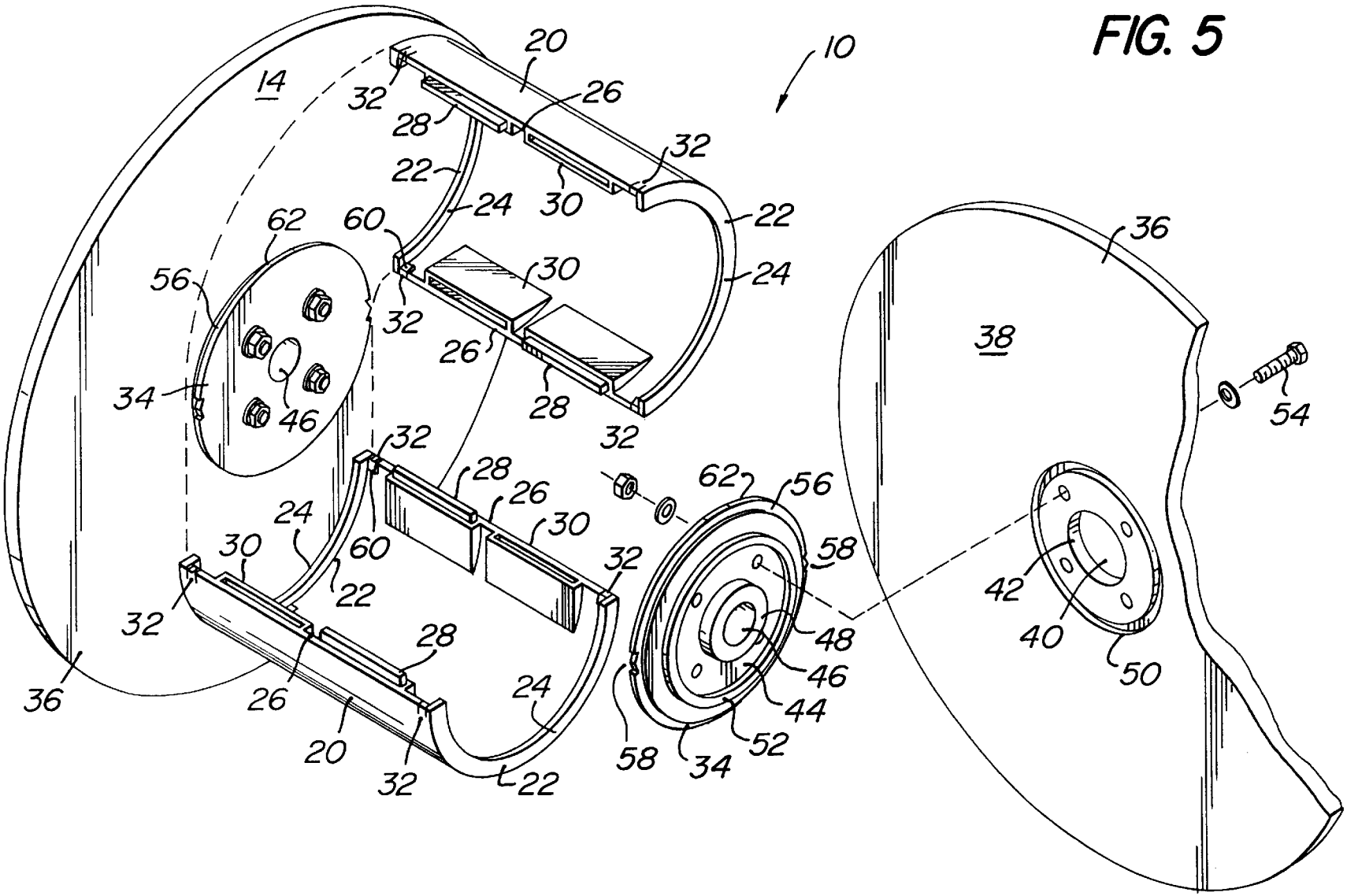
FIG. 5 is a partial exploded perspective view of a reel assembly embodying the present invention.

In the preferred embodiment as illustrated in FIGS. 3 and 5, the hub 34 also engages the locking fingers 32 of the drum segments 20 to lock the reel assembly in the assembled state. To this end, as best illustrated in FIG. 3, the lip 56 of the hub 34 has a plurality of notches 58 which receive and capture abutments 60 extending from the locking fingers 32. Thus, as illustrated, each hub has four notches 58 engaging a pair of locking fingers 32 from a pair of drum segments 20. To disassemble the reel assembly 10, the tip of a screw driver (not shown) can be used to pry the locking fingers out of engagement with the notches 58, and therefore, out of engagement with the end flanges 14 which then are no longer in engagement with the beads 24 of the drum segments 20.

Figure 3A:
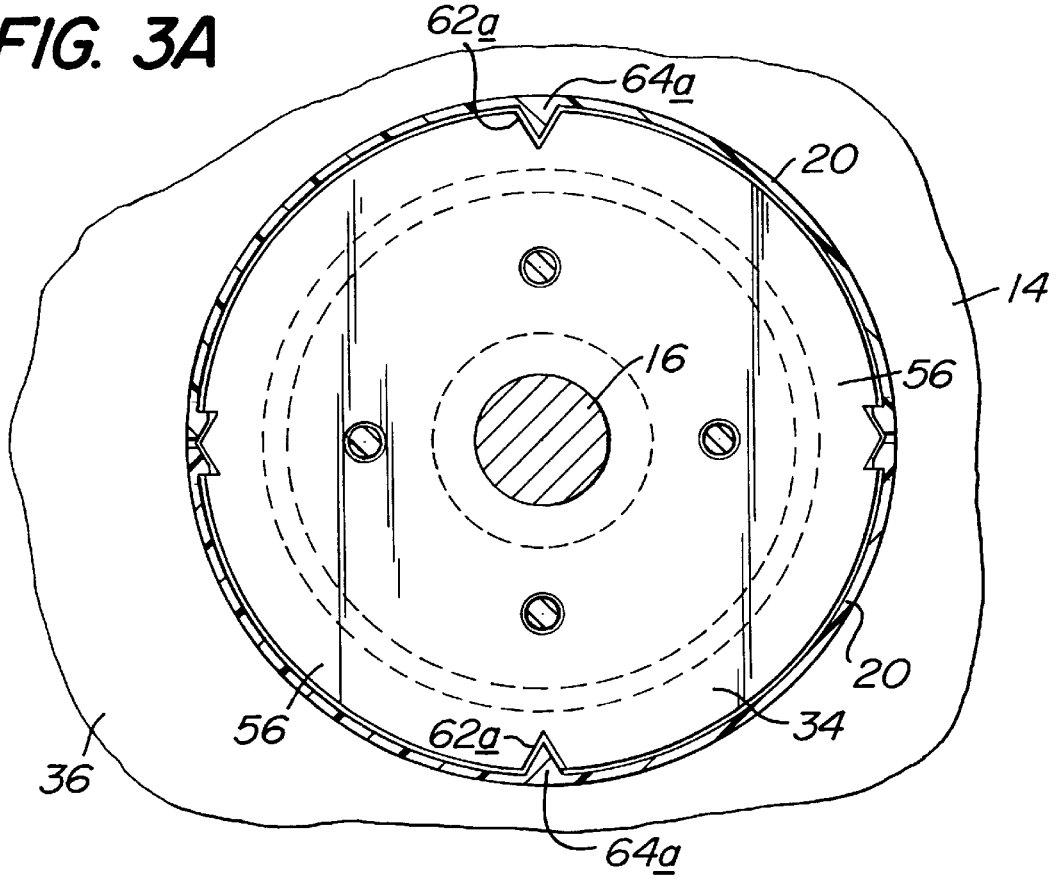
FIG. 3A is a cross-sectional view of an alternate embodiment of FIG. 2, the view taken along the line 3—3.

The hubs 34 and drum segments 20 are provided with means to resist rotation of the drum segments 20 relative to the end flanges 14. The lip 56 of the hubs 34 are interrupted at certain locations by chordal walls 62. For instance, as illustrated in FIG. 5, a pair of chordal walls 62 are located on opposite sides of the hub and are centered between the locations of the notches 58. The drum segments 20 have complementary chordal walls 64 extending inwardly adjacent the beads 24. As best shown in FIG. 3, the chordal walls 62 mate with the complementary chordal walls 64 to provide support to the drum segment-to-end flange connection to resist relative rotation therebetween. In an alternate embodiment illustrated in FIG. 3A, each of the drum segments has spikes 64*a* which mate within spike-receiving slots 62*a* to provide a connection which resists relative rotation.

By way of example, and not by way of limitation, for shipping large packages of flaccid material, each of the drum segments 20 may be about 8, 12 or 16 inches in length, but could be longer or shorter, and be formed at a radius of curvature of about 4, 6 or 8 inches. The skirts 36 should have a thickness of about ¼ inch to about 1 inch, a diameter of up to about 48 inches, and an annular groove 50 with a diameter of about 4, 8 or 12 inches. The locking fingers 32 of the drum segments 20 should be formed as leaf springs having a length of about 1 inch with an abutment 60 extending inwardly about ⅜ inch. The notches 58 should have a depth of about ½ inch into the lip 56, the lip 56 should be spaced from the sidewall 38 of the skirt 36 a distance of about ⅛ to ¾ inch, and the beads 24 should extend inwardly a distance of about ⅛ to ¾ inch.

Figure 7:
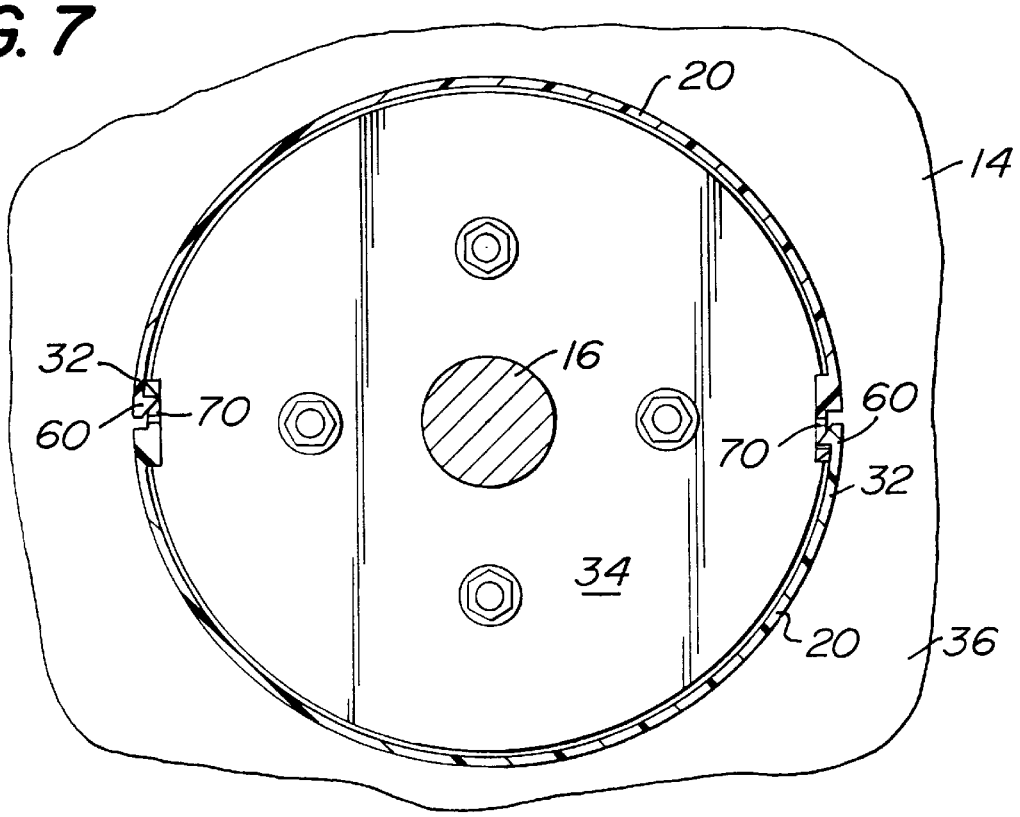
FIG. 7 is a cross-sectional view of an alternate embodiment of a pair of mating drum segments.

Many alternative configurations can be utilized. For instance, in an alternate embodiment illustrated in FIG. 7, the locking fingers 32 lockingly engage a mating drum segment. In such an embodiment, at least one locking finger 32 extends from one elongate side edge of the drum segment, and the other elongate side edge has a cooperating slot 70 for releasably receiving the locking finger. Other alternative configurations include altering the number and type of fasteners used to secure the hub to the skirt, the number and location of the groove and tongue tabs on the drum segments, the number of drum segments utilized, the number of locking fingers utilized, and the shape and size of the chordal walls on the hubs and drum segments.

While preferred drum segment, hub and skirt configurations have been described in detail, various modifications, alterations, and changes may be made without departing from the spirit and scope of the knockdown reel assembly according to the present invention as defined in the appended claims.

We claim:

1. A knockdown reel assembly for shipping flaccid material, the reel assembly having a substantially cylindrical drum for winding the flaccid material therearound and a pair of end flanges located at opposite ends of the drum to retain the flaccid material on the drum between the end flanges, comprising:

a pair of separate, identical arcuate drum segments, each segment having arcuate-shaped opposite ends each mating with one of the end flanges, and each segment having a pair of elongate side edges each mating with one of said elongate side edges of said other segment to form the substantially cylindrical drum;

each of the end flanges having a hub with a central aperture extending axially therethrough and a radially extending lip;

each of said arcuate shaped ends of each of said drum segments having an inwardly extending bead for engaging said lip of said hub to connect said end flanges to said drum segments when said reel assembly is assembled; and means for releasably locking said drum segments to said hub lip when said drum segments side edges are urged into engagement with one another;

wherein said means includes at least one locking finger with a radially inwardly extending abutment peripherally extending from one of said elongate side edges of each of said drum segments; and wherein the other of said elongate side edges has a slot for receiving said abutment of said locking finger to cooperatively form a releasable locking engagement.

2. A knockdown reel assembly for shipping flaccid material, the reel assembly having a substantially cylindrical drum for winding the flaccid material therearound and a pair of end flanges located at opposite ends of the drum to retain the flaccid material on the drum between the end flanges, comprising:

a pair of separate, identical, arcuate drum segments, each segment having arcuate-shaped opposite ends each mating with one of the end flanges, and each segment having a pair of elongate side edges each mating with one of said elongate side edges of said other segment to form the substantially cylindrical drum;

each of the end flanges having a hub with a central aperture extending axially therethrough and a radially extending lip;

each of said arcuate shaped ends of each of said drum segments having an inwardly extending bead for engaging said lip of said hub to connect said end flanges to said drum segments when said reel assembly is assembled; and means for releasably locking said drum segments to said hub lip when said drum segments side edges are urged into engagement with one another;

wherein said means includes at least one locking finger with a radially inwardly extending abutment peripherally extending from at least one of said elongate side edges of each of said drum segments; and wherein said lip of said hub of each end flange has an inwardly extending notch which matingly receives said abutment of said locking finger to cooperatively form a releasable locking engagement.

3. A knockdown reel assembly according to claim 2, wherein both of said elongate side edges of each of said drum segments have a pair of peripherally extending locking fingers each having a radially inwardly extending abutment, one of said locking fingers being located adjacent to each of said arcuate-shaped opposite ends; and wherein said lip of said hub of each of the end flanges has four inwardly extending notches each matingly receiving one of said abutments of said locking fingers to form said releasable locking engagement, whereby each of said arcuate-shaped opposite ends of each of said drum segment is releasably locked to each end flange at a pair of locations.

4. A knockdown reel assembly according to claim 2, wherein each of said drum segments has a pair of inwardly extending chordal walls, one located adjacent each of said beads; wherein each of said hubs has a complementary chordal wall interrupting said radially extending lip; and wherein said chordal walls of said drum segments cooperate with said complementary chordal walls of said hubs to resist rotation of the drum segments with respect to the end flanges.

5. A knockdown reel assembly according to claim 2, wherein each of said drum segments has a pair of inwardly extending spikes, one being located adjacent each of said beads; wherein each of said hubs has a complementary spike-receiving slot which interrupts said radially extending lip; and wherein said spikes of said drum segments cooperate with said complementary spike-receiving slots of said hubs to resist rotation of the drum segments with respect to the end flanges.

6. A knockdown reel assembly according to claim 2, wherein each of said elongate side edges of said drum segments has a tongue tab and a groove tab so that when said pair of drum segments are mated, said tongue and groove tabs interlock and prevent longitudinal movement between said mating drum segments.

7. A knockdown reel assembly according to claim 2, wherein each of the end flanges includes a skirt formed separately of said hub and having a central aperture extending axially therethrough; and wherein said hub is attached to said skirt such that said apertures of said hub and said skirt are axially aligned.

8. A knockdown reel assembly according to claim 7, wherein said skirt has a sidewall for confronting said opposite ends of said drum segments and an annular surface which extends transverse to said sidewall and which defines said skirt central aperture; and wherein said hub has a first annular projection concentric with said hub central aperture for being received within said annular surface of said skirt so that said annular surface is captured by said annular projection of said hub.

9. A knockdown reel assembly according to claim 8, wherein each of said skirts is made of wood, and each of said hubs and drum segments are made of plastic.

10. A drum segment used in a knockdown returnable reel assembly for shipping flaccid material, the assembly including a substantially cylindrical drum for winding the flaccid material therearound and a pair of separate end flanges releasably connected to the cylindrical drum at opposite ends of the cylindrical drum to retain the flaccid material on the cylindrical drum between the end flanges, said drum segment comprising:

a one piece, elongate, arcuate segment for use with an identical segment to form the substantially cylindrical drum, said segment having arcuate-shaped opposite ends for mating with the end flanges and a pair of elongate side edges which mate with an identical pair of elongate side edges of a mating identical segment;

a pair of integrally formed beads extending inwardly from said segment for engaging the end flanges, one of said beads being located adjacent one of said opposite ends and the other of said beads being located adjacent the other of said opposite ends; and a peripherally extending locking finger formed integrally in at least one of said elongate side edges, said locking finger having a radially inwardly extending abutment for maintaining the assembly in releasable locking engagement.

11. A drum segment according to claim 10, wherein said segment has one of said locking fingers with a radially inwardly extending abutment adjacent each of said opposite ends of each of said elongate side edges.

12. A drum segment according to claim 11, further comprising at least one integrally formed chordal wall located adjacent at least one of said beads for cooperating with one of the end flanges of the assembly to resist rotation of the drum segment relative to the end flange of the assembly.

13. A drum segment according to claim 11, further comprising at least one integrally formed spike located adjacent at least one of said beads for cooperating with one of the end flanges of the assembly to resist rotation of the drum segment relative to the end flange of the assembly.

14. A drum segment according to claim 11, further comprising a tongue tab and a groove tab formed on each of said elongate side edges so that when mated with an identical segment said tongue and groove tabs interlock and prevent longitudinal movement between said mating segments.

15. An end flange for use in a knockdown returnable reel assembly for shipping flaccid material, the reel assembly including a substantially cylindrical drum for winding the flaccid material therearound and a pair of separate end flanges releasably connected to the cylindrical drum at opposite ends of the cylindrical drum to retain the flaccid material on the cylindrical drum between the end flanges, said end flange comprising:

a disc-shaped skirt having a sidewall for confronting the cylindrical drum of the reel assembly, an aperture extending centrally and axially therethrough and an inner annular surface extending transverse to said sidewall and defining the aperture;

a separate, one piece, plastic hub having an aperture extending centrally and axially therethrough, a first annular projection concentric with said hub aperture for mating with said inner annular surface of said skirt so that said inner annular surface is captured by said annular projection of said hub, and a radially extending lip located a spaced distance from said skirt and having at least one inwardly extending notch formed therein for cooperating with the cylindrical drum to maintain the reel assembly in a releasable locking engagement; and means for securing said hub to said skirt.

16. An end flange according to claim 15, wherein said sidewall of said skirt has an annular groove formed therein concentric with said aperture; and wherein said hub has a second annular projection concentric with said first annular projection for mating with said annular groove in said sidewall of said skirt,

17. An end flange according to claim 15, wherein said lip has four inwardly extending notches.

18. An end flange according to claim 15, wherein a chordal wall interrupts said radially extending lip for cooperating with the cylindrical drum of the reel assembly to resist rotation of the cylindrical drum relative to the end flange of the reel assembly.

19. An end flange according to claim 15, wherein said lip is interrupted by a slot which cooperates with the cylindrical drum of the reel assembly to resist rotation of the cylindrical drum relative to the end flange of the reel assembly.

* * * * *